US007727092B2

(12) United States Patent
Lignelli et al.

(10) Patent No.: US 7,727,092 B2
(45) Date of Patent: Jun. 1, 2010

(54) MOLDED LACROSSE HEAD POCKET

(75) Inventors: Joanna Lignelli, Baltimore, MD (US); Christopher Saturnio, Crofton, MD (US)

(73) Assignee: WM. T. Burnett IP, LLC, Baltimore, MD (US)

( * ) Notice: Subject to any disclaimer, the term of this patent is extended or adjusted under 35 U.S.C. 154(b) by 389 days.

(21) Appl. No.: 11/739,966

(22) Filed: Apr. 25, 2007

(65) Prior Publication Data

US 2008/0268987 A1 Oct. 30, 2008

(51) Int. Cl.
*A63B 59/02* (2006.01)
*A63B 65/12* (2006.01)

(52) U.S. Cl. ..... 473/513; 473/512; 473/505; D21/724

(58) Field of Classification Search ..... 473/513, 473/512, 505; D21/724
See application file for complete search history.

(56) References Cited

U.S. PATENT DOCUMENTS

| | | | | |
|---|---|---|---|---|
| 3,507,495 | A | 4/1970 | Tucker et al. | |
| 4,034,984 | A | 7/1977 | Crawford et al. | |
| 4,049,273 | A * | 9/1977 | Pool | 473/513 |
| 4,095,790 | A * | 6/1978 | Swiecicki | 473/532 |
| 4,238,262 | A | 12/1980 | Fishel | |
| 4,249,731 | A | 2/1981 | Amster | |
| 4,273,331 | A * | 6/1981 | Fischer | 473/543 |
| 4,913,430 | A * | 4/1990 | Lichtenstein | 473/543 |
| 4,938,480 | A | 7/1990 | Lods | |
| 5,269,532 | A | 12/1993 | Tucker et al. | |
| 5,566,947 | A | 10/1996 | Tucker et al. | |
| 5,570,883 | A * | 11/1996 | Csabai | 473/543 |
| 6,132,325 | A * | 10/2000 | Bertolotti | 473/543 |
| 6,447,410 | B2 | 9/2002 | Crawford | |
| RE037,894 | E | 10/2002 | MacNeil | |
| 6,471,276 | B1 | 10/2002 | Brunsman et al. | |
| 6,506,132 | B1 | 1/2003 | Brine, III et al. | |
| 6,520,875 | B1 | 2/2003 | Crawford | |
| 6,966,854 | B1 | 11/2005 | Gait | |
| 7,022,035 | B2 | 4/2006 | Morrow et al. | |
| 7,070,523 | B1 | 7/2006 | Gait | |
| 2001/0044347 | A1 | 11/2001 | Crawford | |
| 2002/0160865 | A1 | 10/2002 | Brine et al. | |
| 2002/0173389 | A1 | 11/2002 | Morrow | |
| 2006/0258488 | A1 | 11/2006 | Lamson et al. | |

OTHER PUBLICATIONS

International Search Report & Written Opinion, Aug. 12, 2008.
International Preliminary Report on Patentability, Oct. 27, 2009.

* cited by examiner

*Primary Examiner*—Gene Kim
*Assistant Examiner*—Mike Chambers
(74) *Attorney, Agent, or Firm*—Paul, Hastings, Janofsky & Walker LLP

(57) ABSTRACT

A pocket for a head of a lacrosse stick is provided that includes a plurality of runners extending generally in a longitudinal direction and a plurality of cross laces extending generally in a transverse direction. The pocket further includes one or more joint members that are formed at an intersection of a runner and a cross lace. The runner and the cross lace lie over one another and are held in place by the joint member. A method for forming the pocket is also disclosed.

19 Claims, 7 Drawing Sheets

MOLDED LACROSSE HEAD POCKET

BACKGROUND

1. Field of the Invention

The present invention relates generally to lacrosse head pockets and, more particularly, to lacrosse head pockets of unitary construction that may be preformed to reduce burdensome stringing tasks and provide consistency in pockets not found in conventional hand-strung pockets.

2. Background of the Invention

As shown in FIG. 1, a traditional lacrosse stick stringing assembly configuration 10 usually comprises four runners 12 and cross lacing 14. Runners 12, which are usually leather thong elements, extend longitudinally between the scoop 16 in the forward portion of a lacrosse head and the base 23 in the rearward portion of a lacrosse head, attached to, for example, the stop member or throat of the lacrosse head. The runners 12 typically attach to the lacrosse head through apertures, such as the apertures 22 in scoop 16 shown in FIG. 1. Each runner 12 can comprise one or more vertical slits 20 for attaching runner 12 to an aperture 22. An open weave cross lacing 14 comprising cross laces extends transversely to interconnect runners 12 to the head frame and maintain the runners 12 in a predetermined space relation. Open weave cross lacing 14 wraps around runners 12 in certain sections, but may also extend through vertical slits provided in runners 12. The overall assembly thus forms what is referred to as a traditionally strung pocket for catching, carrying, and throwing the lacrosse ball.

Another lacrosse stick stringing configuration known in the art is the mesh configuration. Rather than the longitudinal runners and open weave lacing of the traditional lacrosse pocket stringing configuration, the mesh configuration employs a mesh knitted as a continuous strip of woven material having a plurality of openings or "mesh diamonds" provided therein. The mesh is peripherally coupled to the head of the lacrosse stick by multiple stringing cords or other binding materials.

In traditional-type pockets for lacrosse heads, the multitude of interwoven lacing and/or runners makes adjusting and/or replacing parts or all of the pocket quite burdensome, often requiring the services of a person skilled in stringing lacrosse heads. Even routine adjustments to the pocket due to, for example, stretching or shrinking due to weather or wear, may require the complicated adjustment of several laces and/or runners. In addition, applicable lacrosse rules, such as the U.S. Lacrosse rules governing women's lacrosse, which are adopted by many high school and recreational programs, require players to use the open weave traditional pockets, and prohibit mesh pockets.

Accordingly, there exists a need in the art for a lacrosse head pocket that retains the benefits of a traditional open weave strung pocket, such as the channel effect created by the runners for improved catching, passing and shooting, but that does not suffer the drawbacks related to the complex nature of the stringing pattern.

BRIEF SUMMARY OF THE INVENTION

In accordance with an aspect of the present invention, a lacrosse head pocket is provided that includes a plurality of runners extending generally in a longitudinal direction and a plurality of cross laces extending generally in a transverse direction. The pocket further includes one or more joint members that are formed at an intersection of a runner and a cross lace. The runner and the cross lace lie over one another and are held in place by the joint member, such that the runner and cross lace are secured to prevent their relative displacement at the intersection.

In accordance with a further aspect of the present invention, a method for forming a lacrosse head pocket is provided. A plurality of runners are provided that extend generally in a longitudinal direction and a plurality of cross laces are provided that extend generally in a transverse direction. One or more joint members are formed at an intersection of a runner and a cross lace with the runner and the cross lace lying over one another and held in place by the joint members, such that the runner and cross lace are secured to prevent their relative displacement at the intersection.

DETAILED DESCRIPTION OF THE INVENTION

An embodiment of the present invention is drawn generally to a head for a lacrosse stick, and more particularly to a pocket attached to the head. The head may generally include a frame member having first and second sidewalls, each of the sidewalls having a rearward end and a distal or forward end. The frame member further includes a transverse wall or scoop extending between the forward ends of the sidewalls, and a base extending between the rearward ends of the sidewalls. The base can comprise, for example, a stop member joining the rearward ends of the sidewalls, or can comprise a throat portion joining the sidewalls, with a separate ball stop independent of the sidewalls. The head further preferably comprises a pocket for receiving a ball, the pocket being attached to the frame member.

Figure 1:
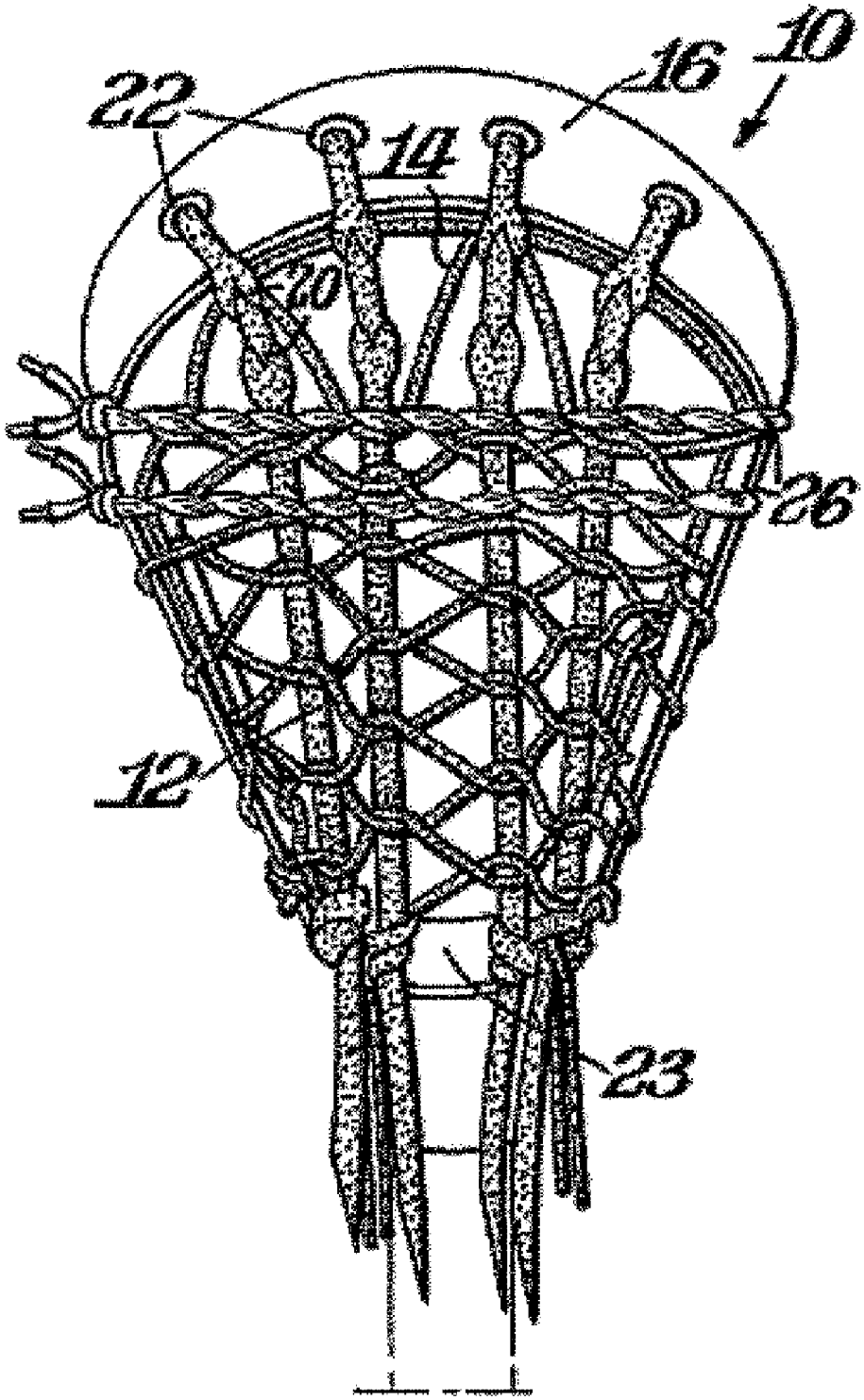
FIG. 1 (Prior Art)
FIG. 1 is a schematic diagram of a conventional traditionally strung lacrosse head.
Figure 2:
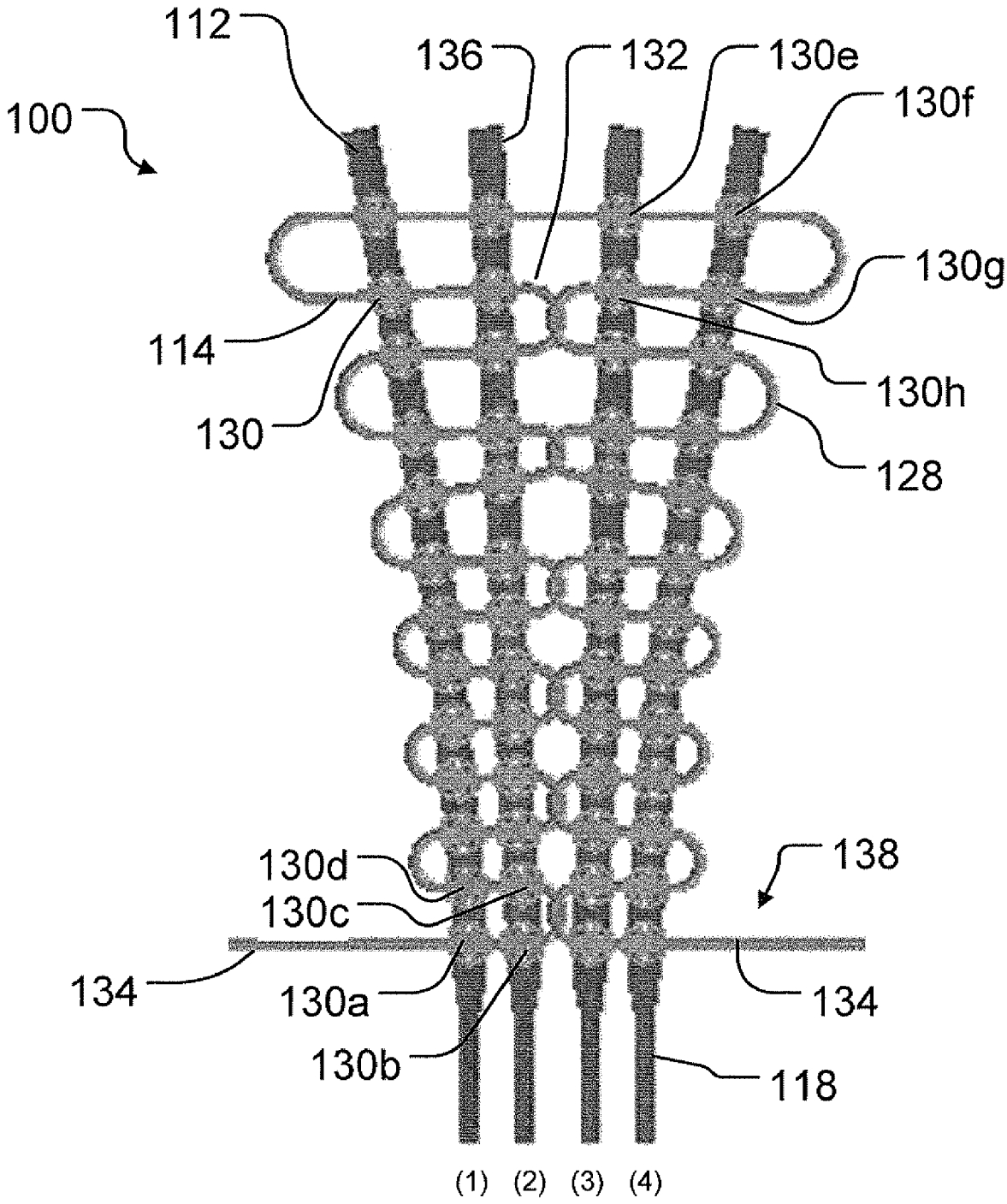
FIG. 2 is a schematic diagram of a lacrosse head pocket in accordance with an embodiment of the present invention.
Figure 3:
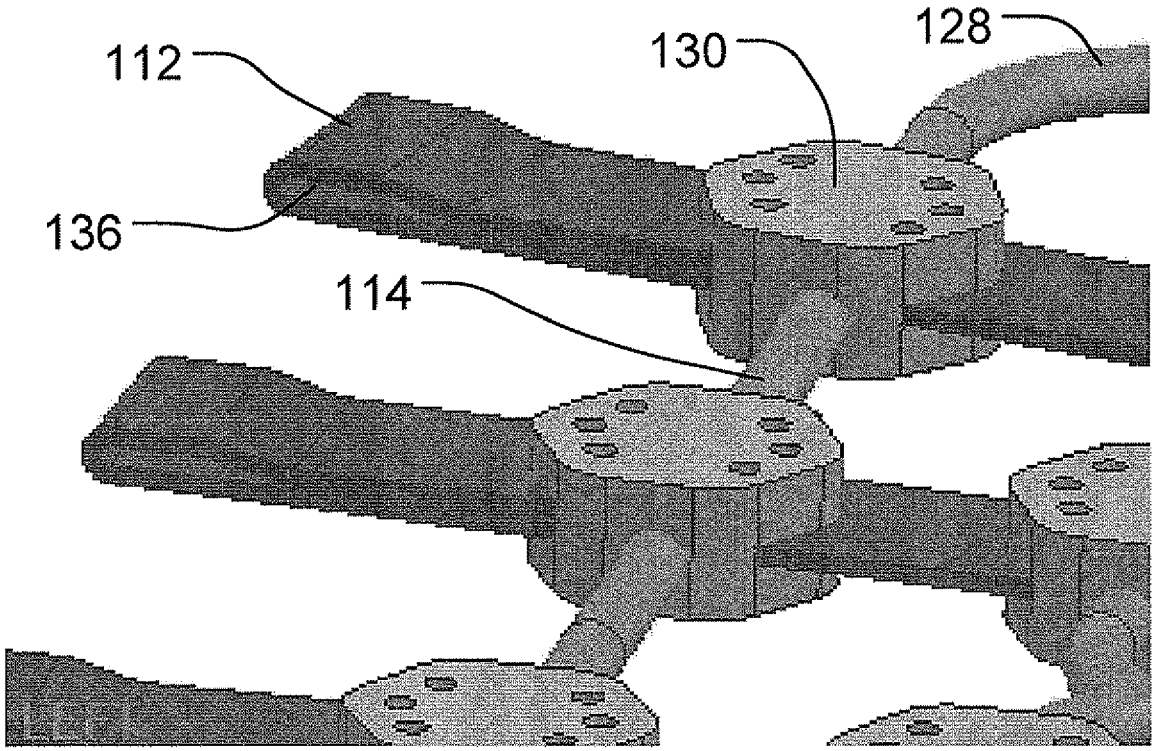
FIG. 3 is a schematic diagram of a detail view of a lacrosse head pocket in accordance with an embodiment of the present invention.

A pocket 100 in accordance with an embodiment of the present invention is shown in FIGS. 2 and 3. The pocket 100 includes a plurality of runners 112 (four runners are shown in FIG. 2), cross laces 114, and joint members 130.

The runners 112 extend generally in a longitudinal direction (e.g., from a rearward portion of a lacrosse head to a forward portion) for attachment between the scoop and the base of the lacrosse head frame. The runners 112 may be made of any suitable material and may be, for example, natural or synthetic leather, nylon, or another synthetic material. As shown in detail in FIG. 3, the runners 112 may include slots or loops 136 through which further laces may be laced for attachment of the runners 112 to the scoop portion of the frame. The slots or loops 136 may be formed by folding over an end portion of each of the runners 112 prior to formation or attachment of the joint members 130, as will be discussed in greater detail below. The runners 112 may have a flat or ribbon-like shape (e.g., having a rectangular cross section) throughout substantially all of its length or may have a more rounded string-like shape (e.g., having a circular cross section). The runners 112 shown in FIGS. 2 and 3 are generally flat (i.e., have a width that is greater than the thickness) and include a tapered portion 118 having a reduced width. Such tapered portion 118 may be provided in order to facilitate the attachment of the runners 112 to a rearward portion of the lacrosse head frame.

The cross laces 114 may be a plurality of string portions extending generally transversely across the runners 112 such that the cross laces 114 and the runners form a plurality of intersections. A single cross lace 114 refers herein to a portion of a string or lace that extends generally transversely to the runners 112. Accordingly, FIG. 2 shows a single length of lace 138 that is considered to comprise several cross lace 114 portions. Although the cross laces 114 shown in the figures are oriented substantially perpendicular to the runners 112, one of skill in the art would appreciate that the cross laces 114 may intersect the runners 112 at any angle. The cross laces 114 may be formed of woven or non-woven synthetic materials, such as nylon or an elastomer.

In accordance with an embodiment of the present invention, the runners 112 may be joined or fused to the cross laces 114 at their intersections by the joint members 130. In this manner, a pocket 100 may be formed of unitary construction, comprising the runners 112, the cross laces 114, and the joint members 130, prior to attachment to a head frame, substantially reducing the amount of labor and skill required to assemble a lacrosse head as compared to traditionally strung lacrosse heads. The pocket 100 may be formed by a manufacturer or other specialist and be simply laced onto a head frame using only sidewall and scoop laces. The sidewall laces may use loops 128 formed by the cross laces 114 for attachment to the sidewalls of the frame, and scoop laces may use the slots 136 in the runners 112 for attachment of the runners to the scoop portion of the frame. Additional laces may be added to the formed pocket, such as shooting strings, as may suit the preferences of the player.

In another embodiment of the present invention, cross laces 114 and/or runners 112 may be configured to engage directly with the sidewalls and/or the scoop, thus obviating the use of separate sidewall or scoop laces. The runners 112 and/or cross laces 114, instead of forming slots 136 and loops 128, respectively, may have lace ends suitable for tying directly to holes in the scoop and/or sidewalls. As another alternative, runners 112 and cross laces 114 could be attached to the lacrosse head frame by first threading their ends through apertures in the lacrosse head frame, folding each of the ends over to form a loop (e.g., loop 136), and then molding a joint member over the folded end to keep the loop in place and the pocket attached to the frame. This method of first threading the pocket through apertures in the frame and then securing the ends of the threads by, for example, molding joint members over the ends, would eliminate the need for separate stringing laces.

In yet another embodiment of the present invention, the length of lace 138 used to form the plurality of cross laces 114 as shown in FIG. 2 may be provided with extra length 134 at an end (such as the forward end of the pocket, which is configured to attach to the forward end of the head frame or the rearward end of the pocket, which is configured to attach to the rearward end of the head frame) so that the lace 138 itself includes an integrated sidewall and/or scoop lace. Accordingly, the extra length 134 may be used to lace the pocket 100 onto the head frame, obviating the need for additional sidewall and/or scoop laces.

In an embodiment of the present invention, the joint members 130 are formed of a natural or synthetic polymer (e.g., rubber, nylon, or an elastomer), a foam, or any suitable material that can be molded onto the intersections of the runners 112 and the cross laces 114. The joint members 130 may be molded by, for example, direct injection molding, which process is discussed in greater detail below.

In a further embodiment of the present invention, the upper surface of the joint members 130 on a ball receiving side of the pocket, or the bottom surface of the joint members 130 on the opposite side of the pocket, is shaped to affect the interaction of the pocket with a lacrosse ball. For example, the upper surface can be textured to enhance grip with a ball. Such texture can include, for example, ridges, grooves, protrusions, nubs, dimples, or knurling. The texture can also be provided by the material of the joint member itself including, for example, grit or any other materials that increase friction with a standard rubber lacrosse ball. Additionally or alternatively, the ball-receiving surface of one or more joint members may be concave to provide a cupping effect with a ball, to improve catching, cradling, and shooting. As another example, on a side of the pocket opposite the ball-receiving side, joint members in certain areas can have a convex or smooth surface to aid in reducing friction against the ground during scooping actions, and in other areas, can have texture to aid in gripping a ball during face-offs or draws that commence play in the men's and women's game respectively, both of which involve opponents pressing the sides of the pocket opposite the ball-receiving sides against one another. The surface features of the joint members 130 can be molded during the direct injection molding process.

In a specific implementation of the present invention, joint members 130 are made of nylon or elastomeric materials, and are cylindrical in shape, having a diameter of up to about 15 mm and a thickness of up to about 6 mm. This material and these dimensions allow the joint members to bend, which provides the overall pocket with flexibility. In alternative embodiments, the joint members may have other shapes that allow for more or less flexibility and/or strength, as desired. For example, the joint members may be shaped as triangular, rectangular, or hexagonal prisms.

FIG. 2 shows an exemplary lace pattern for a pocket 100 in accordance with an embodiment of the present invention. The lace pattern shown in FIG. 2 is characterized by the use of a single length of lace 138 to form each of the plurality of cross laces 114 in such a manner that an adequate number of attachment loops 128 are formed in a symmetrical manner (symmetry being a preferred characteristic so as to reduce a directional bias in the handling of a lacrosse ball). For illustrative purposes, the four runners 112 shown in FIG. 2 will be referred to as first runner (1), second runner (2), third runner (3), and fourth runner (4). In addition, any description relating to a sequence of events is merely illustrative and is not intended to place any chronological limitations on the construction of the invention. Accordingly, the described embodiment may be constructed in a reverse sequence from that described or in any other suitable sequence.

As shown, the length of lace 138 begins at a rearward portion of the pocket 100 by intersecting the first runner (1)

and is joined thereto by a first joint member 130*a*. The lace 138 then extends to the second runner (2) and is joined thereto by a second joint member 130*b* at a first location. The lace 138 then forms a loop 132 and is joined again with the second runner (2) at a second location by a third joint member 130*c*. The lace 138 then extends back to the first runner (1) and is joined thereto by a fourth joint member 130*d*. The lace 138 then forms a loop 128 and joins again with the first runner (1), repeating the four-joint member pattern along the length of the first (1) and second (2) runners until it reaches a distal forward portion of the pocket 100. A die may be configured with the desired spacing of intersection points so that the runners 112 and the lace 138 are simply laid across the die.

At the end of the last four-joint member pattern on the first (1) and second (2) runners 112 at the distal end of the pocket 100, the lace 138 is joined again with the first runner (1) and then the second runner (2) so that the lace 138 extends in a direction toward the third runner (3). From there, it is joined with joint member 130*e* on the third runner (3) and then joint member 130*f* on the fourth runner (4). The lace 138 then forms a loop 128 and again joins with the fourth runner (4) with joint member 130*g*, and then the third runner (3) with joint member 130*h*. The lace 138 is then looped around a loop 132 previously formed by the lace 138 between two joint members 130 on the second runner (2). The lace 138 then repeats the four-joint member pattern, as previously described, on the third (3) and fourth (4) runners 112, looping around the previously formed loops 132 on the second runner (2) after each repetition.

At the end of the last four-joint member pattern on the third (3) and fourth (4) runners 112 at the rearward end of the pocket 100, and after looping around previously formed loop 132 on the second runner (2), the lace 138 is joined once again to the third runner (3) and then the fourth runner (4) so that it extends in a direction away from the center of the pocket 100. This extra length 134 of the lace 138, as well as the extra length 134 extending from the first runner (1), may be used to lace the pocket 100 to the head frame, may be cut away, or may simply be tied to a portion of the head to be kept out of the way.

The lace pattern shown in FIG. 2 facilitates a simplified assembly and molding process by using one continuous cross lace 138. In addition, by routing the cross lace 138 over the two left runners and then the two right runners and linking the two halves together with loops 132, the lace pattern creates a symmetrical pocket that conveniently attaches to the thread holes of a typical lacrosse head and provides for a balanced pocket. In addition, the loops 132 can be configured to provide a channel between the middle two runners, for example, increasing the length of the loops to widen the distance between the middle two runners, as desired to meet certain performance characteristics (e.g., allowing a ball to fall deeper in the pocket between the middle two runners and remain in that channel when the ball travels from the rearward portion of the lacrosse head to the forward or distal portion during a throwing motion). Optionally, instead of linking loops 132, these intersections can be held in place using joint members in the same fashion as described above with respect to an intersecting runner and cross lace.

One of skill in the art will appreciate that the pocket lace pattern is not limited to that shown in FIG. 2 and various other patterns may be formed in accordance with the present invention. A great variety of lace patterns may be used as the spirit of the present invention is not limited to any particular pattern. For example, where rules allow for eight to thirteen cross laces, any pattern that meets this requirement may be suitable. Further, loops 132 in FIG. 2 may be eliminated and lace 134 may intersect with and join all four runners 112 to form a lace pattern. Loop 128 may also be eliminated in some embodiments to allow cross laces 114 to be tied directly to the lacrosse head frame.

Figure 4:
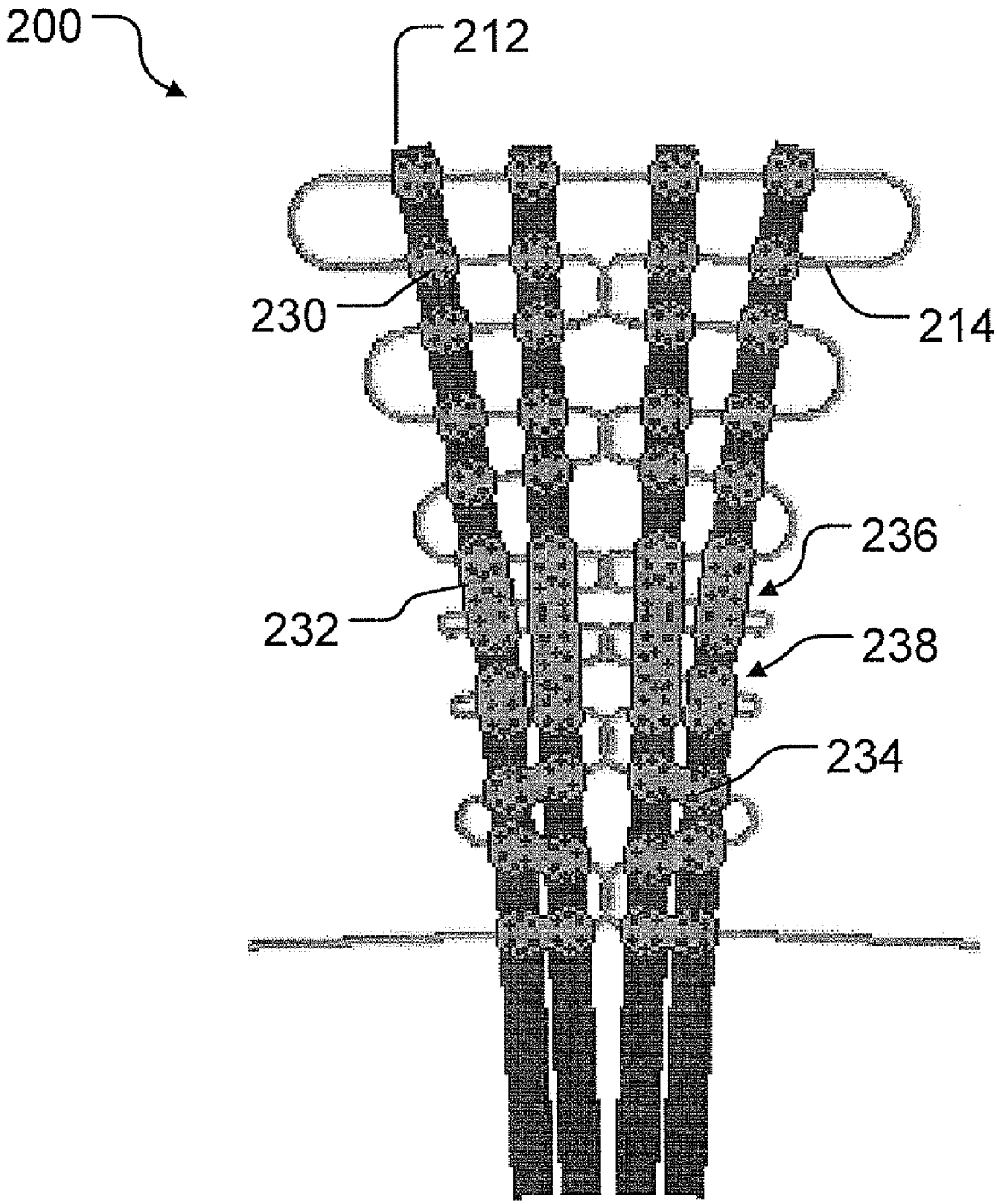
FIG. 4 is a schematic diagram of a lacrosse head pocket having joint members joining runners and cross laces at two or more intersections in accordance with another embodiment of the present invention.

FIG. 4 shows a further embodiment of a pocket 200 in accordance with the present invention. In the pocket 200 shown in FIG. 4, runners 212, cross laces 214, and joint members 230 are provided in generally the same manner as described above. The pocket 200 differs in that longitudinal joint members 232 and transverse joint members 234 are provided that join the runners 212 and the cross laces 214 at two or more intersections simultaneously. The longitudinal joint members 232 may extend along the runners 212 to join the cross laces 214 to the runners 212 at two or more adjacent intersections along the runners 212. Similarly, the transverse joint members 234 may extend from one runner 212 to an adjacent runner 212 to join the cross laces 214 to the runners 212 at two or more adjacent intersections in the transverse direction.

FIG. 4 additionally shows cross laces 214 intersecting the runners 212 in a generally transverse direction but not perpendicular, such as intersections 236 and 238.

Overall, the present invention provides a pocket formed of an integral construction that may be easily and quickly laced into a lacrosse head frame in its entirety. With reference to FIG. 2, the relative positions of the cross laces 114 with respect to the runners 112 are predetermined and fixed by the joint members 130, thereby reducing the need for tedious pocket adjustment and facilitating pocket consistency that enhances consistent playability. Suitable sidewall laces may be implemented to facilitate the connection of the pocket 100 to the sidewalls by engaging with loop portions 128 of the cross laces 114 disposed on the side of the pocket 100 and with holes provided in the sidewall portions of the head. A scoop lace may further be implemented to facilitate the connection of the pocket 100 to the scoop by engaging with slots 136 formed in the runners 112 and with holes provided in the scoop portion of the head. As discussed above, the pocket 100 may alternatively be capable of being attached to the head frame by the runners 112 or the cross laces 114 themselves or by any other strings and/or laces that are made part of the pocket 100.

Figure 5:
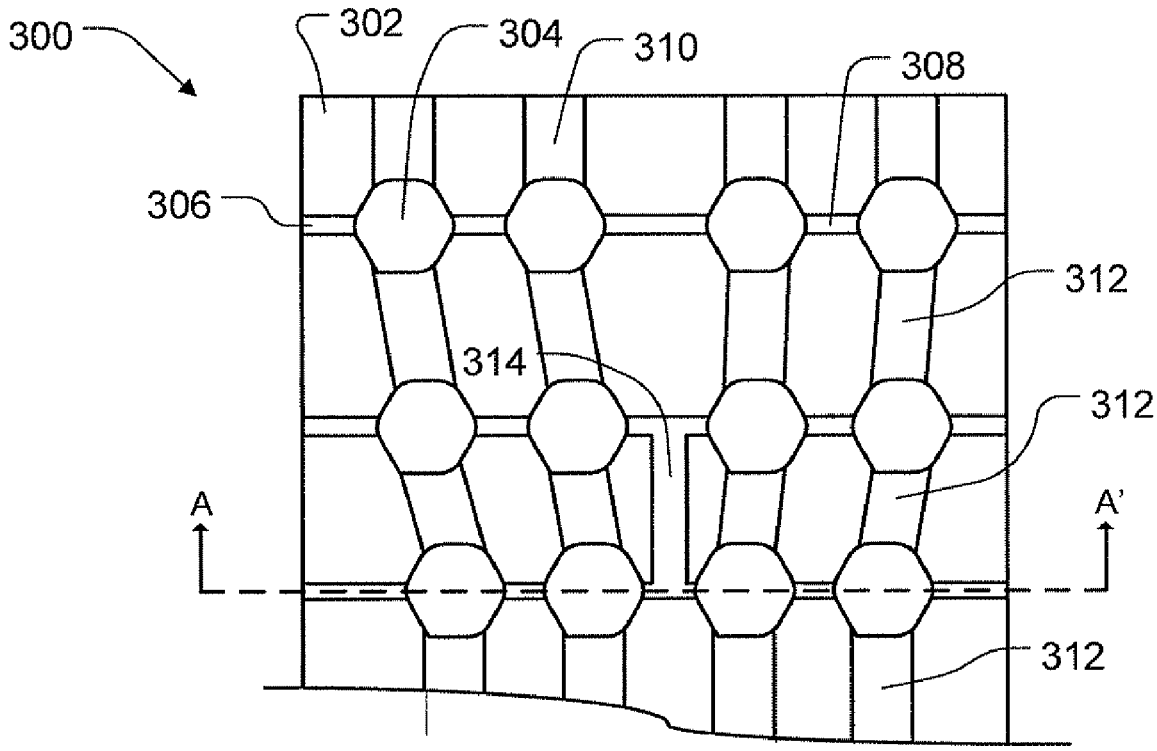
FIG. 5 is a schematic diagram of a portion of a mold in accordance with an embodiment of the present invention.
Figure 5A:
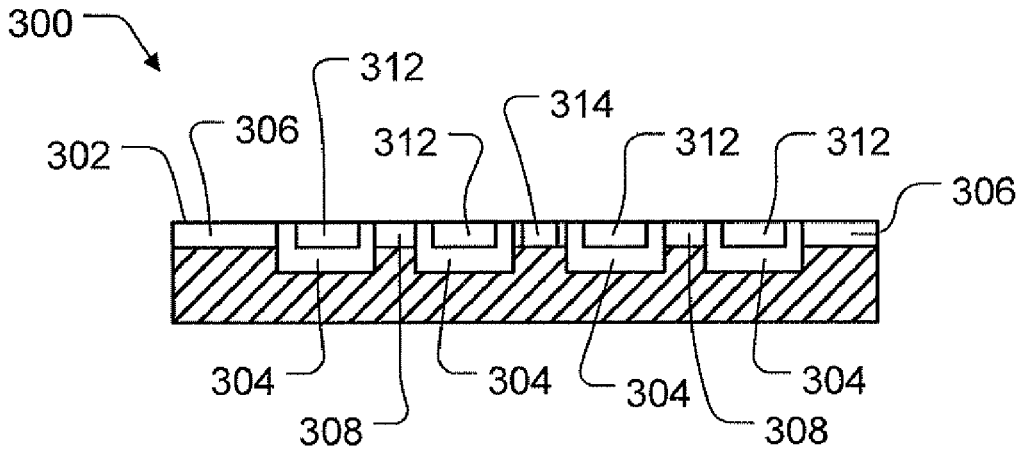
FIG. 5A is a schematic cross-sectional diagram of the mold portion shown in FIG. 5, taken along line A-A', in accordance with an embodiment of the present invention.

FIGS. 5 and 5A illustrate a bottom portion 300 of a mold that may be used in an embodiment of the present invention. FIG. 5A is a cross-sectional view of the mold portion shown in FIG. 5 taken along line A-A'. The bottom portion 300 includes an abutting face 302 for engagement against a face of a top portion during the molding process. The bottom portion 300 further includes joint member cavities 304, peripheral lace channels 306, connecting lace channels 308, peripheral runner channels 310, connecting runner channels 312, and loop channel 314.

Only the bottom half of a mold is shown in FIGS. 5 and 5A for illustrative purposes. It would be appreciated by one having skill in the art that a top portion is substantially a mirror image of the bottom portion 300. It would also be appreciated that the top portion in other embodiments may take a form that is not a mirror image of the bottom portion 300. For example, if the channels 306, 308, 310, 312 are made deep enough in the bottom portion 300, then corresponding channels may be omitted in the formation of the top portion. Additionally, the entire height of the cavities 304 may be formed in the bottom portion 300 with the channels 306, 308, 310, 312 formed as bores through the bottom portion 300. In such an embodiment, the top portion may take the form of a substantially flat cover piece with no channels or cavities corresponding to channels 306, 308, 310, 312 and cavities 304 in the bottom portion 300.

Figure 5B:
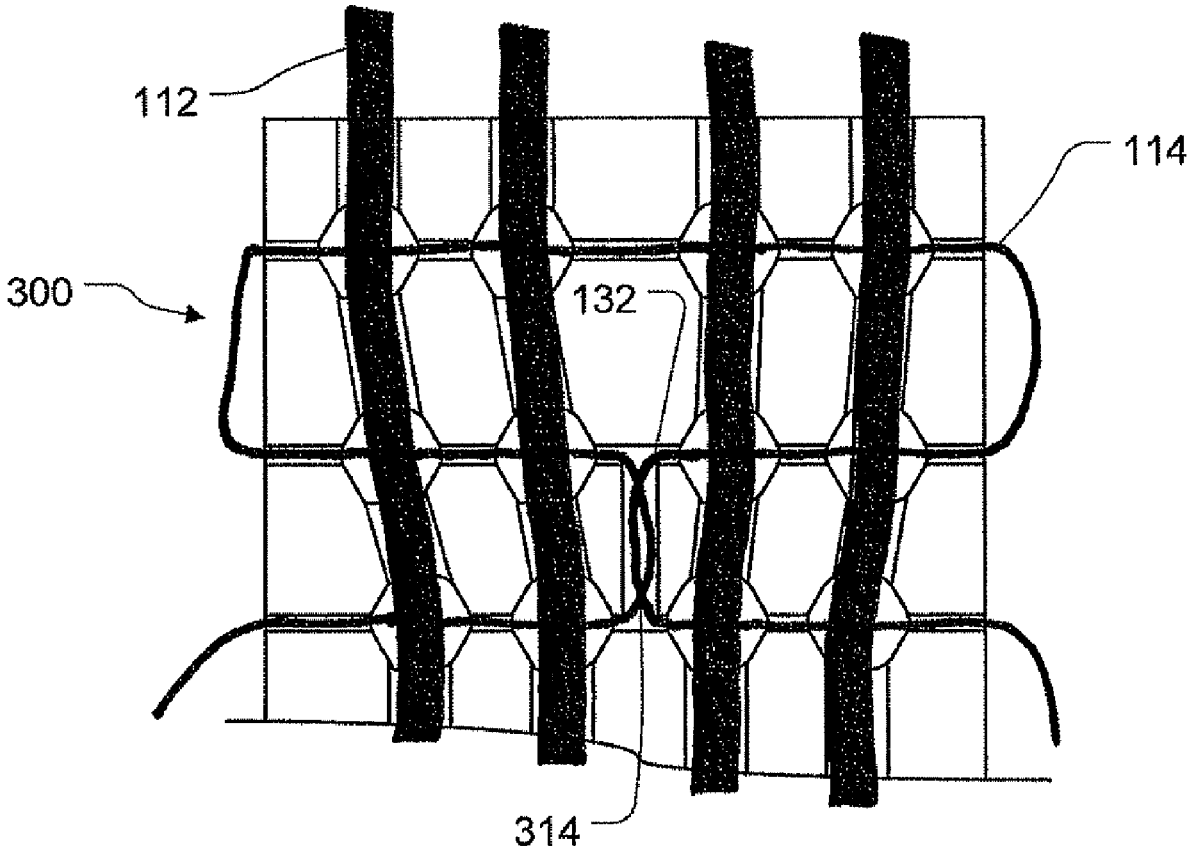
FIG. 5B is a schematic diagram of a mold portion with runners and laces laid thereon in accordance with an embodiment of the present invention.
Figure 6:
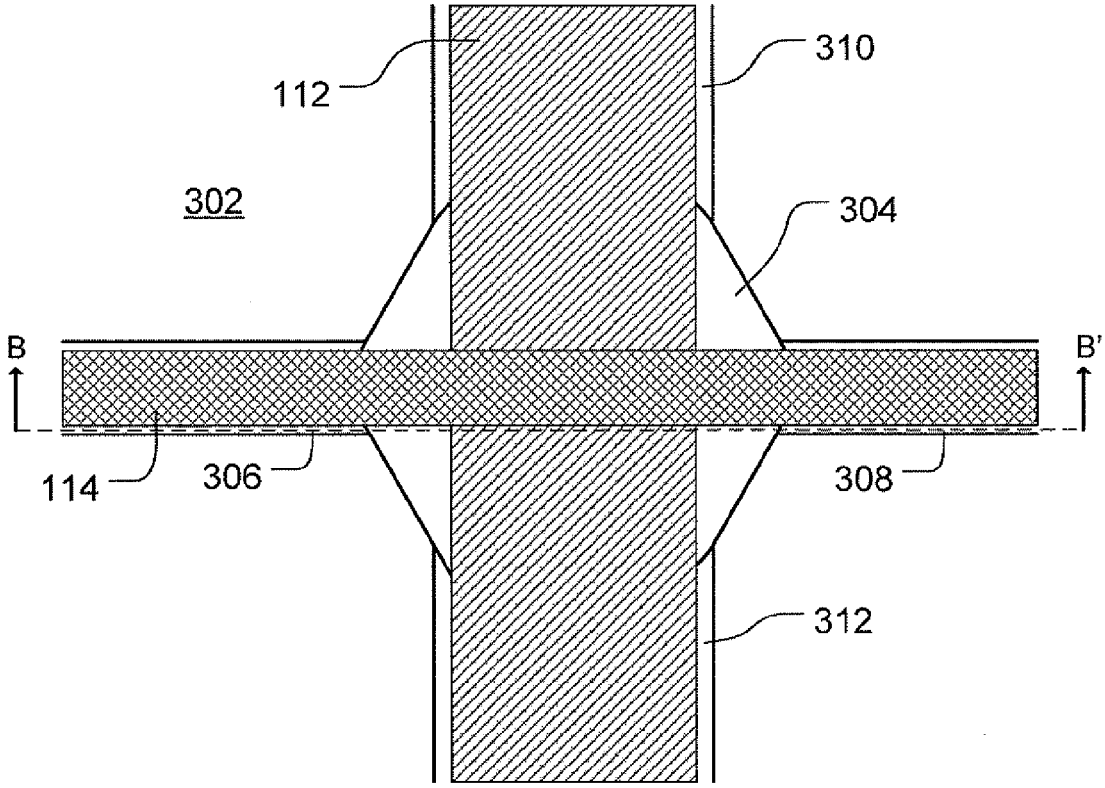
FIG. 6 is a detailed schematic diagram of the intersection of a runner and a lace in a mold portion in accordance with an embodiment of the present invention.
Figure 6A:
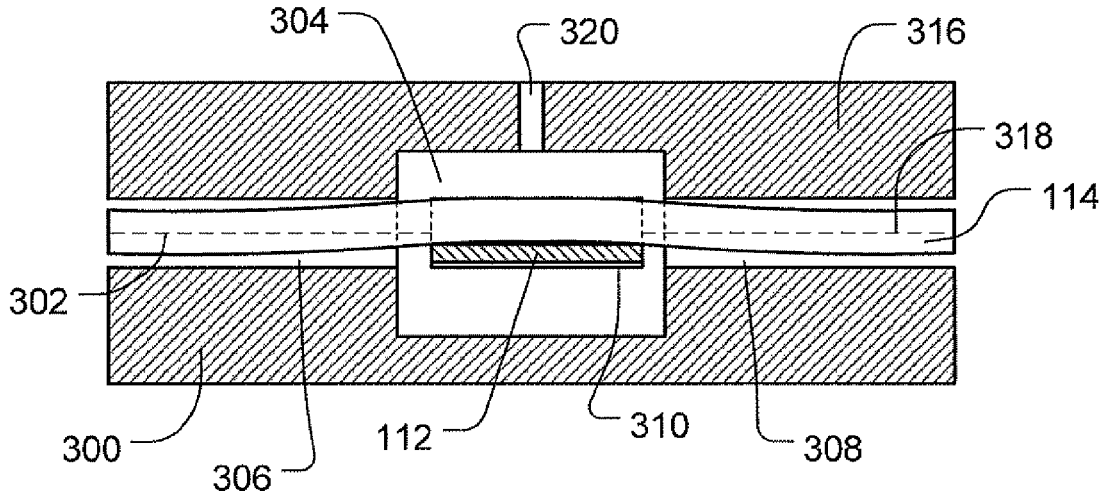
FIG. 6A is a schematic cross-sectional diagram of the intersection shown in FIG. 6, taken along line B-B', in accordance with an embodiment of the present invention.

As shown in FIGS. 5 and 5A and with further reference to FIGS. 5B, 6, and 6A, the runners 112 and the cross laces 114 may first be placed in a desired lace pattern in the die or mold portion 300 such that they cross over one another to form a plurality of intersections. The desired lace pattern is defined by channels in the tool according to a predetermined desired pocket design, which may depend on a variety of factors such as the relevant playing rules, the dimensions of the head to which the pocket is attached, or predetermined player preferences. The bottom portion 300 shown in FIG. 5 has channels 306, 308, 310, 312 oriented in a manner to construct a lace pattern substantially as that shown in FIG. 2 (note only a bottom portion of the mold 300 is shown in FIG. 5 for illustrative purposes). FIG. 5B shows the bottom portion 300 of the mold with runners 112 and laces 114 placed in the appropriate channels to form the lace pattern of FIG. 2. Loop channels 314 are provided in bottom portion 300 and are wide enough to accommodate the widths of at least two laces 114. The loop channels 314 allow for the formation of the interlocking loops 132 as used in the lace pattern of FIG. 2. One of skill in the art would appreciate that the bottom portion 300 as shown in the figures may be used to construct a different lace pattern as desired or that mold portions may be formed with differently oriented channels so as to make other lace patterns including, but not limited to, any alternative lace pattern described herein.

The intersections of the runners 112 and the laces 114 preferably occur at approximately the geometric center of the cavities 304, as shown in detail in FIG. 6 and in FIG. 6A, which is a cross-sectional view of the cavity 304 and intersection of runner 112 and lace 114 shown in FIG. 6, taken along line B-B'. The cavity 304 illustrated in FIGS. 6 and 6A is the top leftmost cavity 304 on the bottom portion 300 shown in FIG. 5B. Accordingly, peripheral lace channel 306, connecting lace channel 308, peripheral runner channel 310, and connecting runner channel 312 are shown.

FIG. 6A further depicts a portion of a top mold portion 316 in abutting relationship with the bottom portion 300. The top portion 316 includes an abutting face 318 for engagement with the abutting face 302 of the bottom portion 300. The top portion 316 further includes channel portions 306, 308 for engagement with corresponding channels 306, 308 in the bottom portion 300.

It is noted that the drawings are not to scale and, as such, the runners 112 and laces 114 may be shown as taking up more or less space within the channels than they would otherwise occupy in order to undergo the direct injection molding process. Since molten material will be injected and formed within the cavities 304, it may be desirable to prevent the infiltration of material into the channels 306, 308, 310, 312 at least to a substantial extent. As such, the channels 306, 308, 310, 312 are preferably constructed to substantially match the dimensions of the runners 112 and laces 114. Alternatively, spacers or partitions (not shown) may be provided around the runners 112 and laces 114 and within oversized channels in order to prevent the infiltration of molten materials.

The cavity 304 shown in FIGS. 6 and 6A is shaped generally as a hexagonal prism and has the runner 112 and the lace 114 intersecting at approximately the radial center (as can be seen in FIG. 6) as well as its longitudinal center (as can be seen in FIG. 6A). One skilled in the art would appreciate that the intersection may occur at locations other than the radial and longitudinal centers of the cavities 304. For example, the intersection may be configured to occur at a distance farther from the bottom mold portion 300 so that the formed joint member 130 may be less obtrusive on a ball receiving side of a lacrosse pocket. Conversely, the intersections of the runners 112 and the laces 114 may be configured to be closer to the bottom portion 300 such that the joint members 130 protrude into the ball receiving side of the pocket to a greater degree in order to have a more substantial effect on ball handling.

The cavities 304 are shown in the figures as having generally hexagonal radial cross-sections. One of skill in the art would appreciate that any suitable cross-section may be used for the cavities 304, corresponding to any desired shape for the joint members 130 as discussed above. For example, the cavities may have circular, triangular, rectangular, or any other cross-section suitable for construction of appropriately shaped joint members 130.

Once the runners 112 and laces 114 are laid into the channels 306, 308, 310, 312 provided in the bottom portion 300, the top portion 316 is moved into abutting relationship with the bottom portion 300 and held there, preferably by pressurized means (e.g., by hydraulic piston or clamp). Where applicable, cavities formed in the top portion 316 for the joint members 130 are mated with the corresponding cavities 304 in the bottom portion 300 and corresponding channels are likewise mated.

Then, molten material used for the formation of joint members 130 is injected into the cavities 304, through a port 320 in the top mold portion 316. The molten material forms over, into, and around the intersecting runners 112 and cross laces 114. Depending on the material of the laces 114 and runners 112, a chemical and/or mechanical bond may be formed with the joint members 130 through heating and bonding. Optionally, distal ends of the runners 112 may be folded back prior to molding such that the ends of the runners 112 are coincident with the intersection of the runner 112 and the cross lace 114. In this manner, slots or loops 136 at the distal ends of the runners 112 are created upon the formation of the joint members 130. A pocket 100 having a desired lace pattern is thus formed of unitary construction that may be easily laced into a head frame of a lacrosse stick.

Although shown as an injection port 320 in the top portion 316, molten material may be injected into the cavities 304 by any other suitable means. Further, an injection port may be instead or additionally provided in the bottom portion 300. It would be appreciated that the terms "bottom" and "top" in reference to the mold portions are arbitrary and are used only for illustrative purposes. As such, any feature described with reference to a "bottom" portion or a "top" portion may be implemented in the opposite portion as desired without regard to any directional limitations. The direct injection process described herein is merely exemplary. Variations and alterations from the process described may be practiced by those skilled in the art without departing from the scope and spirit of the present invention.

By using direct injection molding to form the joint members 130, the present invention can achieve a strong chemical and/or mechanical connection between the runners and cross laces. The joint member 130 can fully encase the intersection of the materials comprising the runners 112 and cross lacing 114 and, because it is injected in liquid form, can completely fill in the gaps between the intersecting laces and/or within the laces themselves. For example, the direct injection molding can essentially fuse any threads together utilizing the porosities of the threads. Thus, with porous fibers, the injected liquid (e.g., molten plastic or elastomer) can penetrate into and through the pores of both threads and fuse the intersecting threads together as a monolithic part. With fibers or laces having little or no porosity, the injected liquid may still form a strong attachment with the laces by forming onto, within, and around the microscopic contours and/or pores on the surface of the material.

In addition, the direct injection molding process of the present invention not only provides a strong and durable pocket, but enables large-scale production of many pockets at a consistently high quality. Rather than relying on technicians or players to weave traditional pockets, the present invention provides a scalable and precise assembly method that can meet high volume production needs. The method produces consistent pockets that meet widely accepted rules defining traditionally strung pockets.

The foregoing disclosure of the preferred embodiments of the present invention has been presented for purposes of illustration and description. It is not intended to be exhaustive or to limit the invention to the precise forms disclosed. Many variations and modifications of the embodiments described herein will be apparent to one of ordinary skill in the art in light of the above disclosure. The scope of the invention is to be defined only by the claims appended hereto, and by their equivalents.

Further, in describing representative embodiments of the present invention, the specification may have presented the method and/or process of the present invention as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process of the present invention should not be limited to the performance of their steps in the order written, and one skilled in the art can readily appreciate that the sequences may be varied and still remain within the spirit and scope of the present invention.

What is claimed is:

1. A pocket for a head of a lacrosse stick, comprising:

a plurality of runners extending generally in a longitudinal direction;

a plurality of cross laces extending generally in a transverse direction; and a plurality of individual joint members, wherein each of the joint members is formed at an intersection of a runner and a cross lace such that the runner and the cross lace are secured to prevent their relative displacement at the intersection, wherein the plurality of runners comprises a first runner, a second runner, a third runner, and a fourth runner, and the pocket forms a lace pattern, wherein a first cross lace extends from a first joint member on the first runner to a second joint member on the second runner to a third joint member on the second runner and to a fourth joint member on the first runner, wherein a second cross lace extends from a fifth joint member on the fourth runner to a sixth joint member on the third runner to a seventh joint member on the third runner and to an eighth joint member on the fourth runner, wherein the first cross lace, in a portion of the first cross lace extending between the second joint member and the third joint member, engages with the second cross lace, in a portion of the second cross lace extending between the sixth joint member and the seventh joint member, such that the first and second runners are connected with the third and fourth runners, wherein the each joint member is separately formed of a material different from material of the runner and the cross lace, wherein the each joint member is discontinuous with remaining joint members of the plurality of joint members, and wherein the each joint member, at the intersection of the runner and the cross lace, encases the runner and the cross lace.

2. The pocket of claim 1, wherein the plurality of cross strings laces are joined at each of their ends such that all of the cross laces together constitute a single length of lace.

3. The pocket of claim 1, wherein the lace pattern is repeated along the lengths of the runners.

4. The pocket of claim 1, wherein the joint members are formed of one of a polymer, a foam, and combinations thereof.

5. The pocket of claim 1, wherein the runners are formed of one of nylon, natural leather, and synthetic leather.

6. The pocket of claim 1, wherein the each joint member is direct injection molded over the intersection of the runner and cross lace.

7. The pocket of claim 1, wherein a surface of the plurality of individual joint members on a ball-receiving side of the pocket is concave.

8. The pocket of claim 1, wherein a surface of the plurality of individual joint members on a ball-receiving side of the pocket comprises at least one of ridges, grooves, protrusions, nubs, dimples, and knurling.

9. The pocket of claim 1, wherein a joint member of the plurality of individual joint members is shaped as a cylinder, and wherein the intersection of the runner and the cross lace is disposed at approximately the geometric center of the cylinder.

10. The pocket of claim 1, wherein a runner of the plurality of runners has a loop at its end formed by folding an end of the runner over itself and holding the end in place with one of the plurality of individual joint members.

11. The pocket of claim 1, wherein the plurality of runners and the plurality of cross laces are porous and wherein portions of the joint members are disposed within and through pores of the plurality of runners and the plurality of cross laces.

12. The pocket of claim 1, wherein the first cross lace forms a first loop at the portion of the first cross lace between the second joint member and the third joint member, wherein the second cross lace forms a second loop at the portion of the second cross lace between the sixth joint member and the seventh joint member, and wherein the first loop and the second loop are linked to each other such that the first cross lace and the second cross lace engage each other to limit the distance to which the second runner and the third runner can separate, and such that the first cross lace and the second cross lace slide over each other to enable the second runner to move toward the third runner.

13. A pocket for a head of a lacrosse stick, comprising:

a first runner extending generally in a longitudinal direction;

a second runner extending generally in the longitudinal direction, wherein the first runner and the second runner are positioned approximately equidistant from a centerline of the pocket corresponding generally to a centerline of the head, and wherein the first runner and the second runner define a ball channel along the centerline of the pocket;

a first joint member disposed on the first runner;

a second joint member disposed on the first runner spaced apart from the first joint member;

a first cross lace loop having a first end all ached to the first runner by the first joint member, wherein the first joint member is formed at the intersection of the first end of the first cross lace loop and the first runner to prevent their relative displacement at the intersection, and a second end attached to the first runner by the second joint member, wherein the second joint member is formed at the intersection of the second end of the first cross lace loop and the first runner to prevent their relative displacement at the intersection;

a third joint member disposed on the second runner;

a fourth joint member disposed on the second runner spaced apart from the third joint member; and a second cross lace loop having a first end attached to the second runner by the third joint member, wherein the third joint member is formed at the intersection of the first end of the second cross lace loop and the second runner to prevent their relative displacement at the intersection, and a second end attached to the second runner by the fourth joint member, wherein the fourth joint member is formed at the intersection of the second end of the second cross lace loop and the second runner to prevent their relative displacement at the intersection, wherein the first cross lace loon and the second cross lace loon are linked to each other and wherein the each joint member is separately formed of a material different from material of the runner and the cross lace.

14. The pocket of claim 13, wherein the first, second, third, and fourth joint members are formed of one of a polymer, a foam, and combinations thereof.

15. The pocket of claim 13, wherein the first and second runners are formed of one of nylon, natural leather, and synthetic leather.

16. The pocket of claim 13, wherein a surface of the first, second, third, and fourth joint members on a ball-receiving side of the pocket is concave.

17. The pocket of claim 13, wherein a surface of the first, second, third, and fourth joint members on a bail-receiving side of the pocket comprises at least one of ridges, grooves, protrusions, nubs, dimples, and knurling.

18. The pocket of claim 13, wherein the first and second runners and the first and second cross lace loops are porous and wherein portions of the first, second, third, and fourth joint members are disposed within and through pores of the first and second runners and the first and second cross lace loops.

19. A pocket for a head of a lacrosse stick, comprising:

a plurality of runners extending generally in a longitudinal direction;

a plurality of cross laces extending generally in a transverse direction; and a plurality of individual joint members, wherein each of the joint members is formed at an intersection of a runner and a cross lace such that the runner and the cross lace are secured to prevent their relative displacement at the intersection, wherein the plurality of runners comprises a first runner and a second runner, and the pocket forms a lace pattern, wherein a first cross lace extends from a first joint member on the first runner to a second joint member on the first runner, wherein a second cross lace extends from a third joint member on the second runner to a fourth joint member on the second runner, wherein the first cross lace, in a portion of the first cross lace extending between the first joint member and the second joint member, engages with the second cross lace, in a portion of the second cross lace extending between the third joint member and the fourth joint member, such that the first and second runners are connected, wherein the each joint member is separately formed of a material different from material of the runner and the cross lace, wherein the each joint member is discontinuous with remaining joint members of the plurality of joint members, and wherein the each joint member, at the intersection of the runner and the cross lace, encases the runner and the cross lace.

* * * * *